US006041967A

United States Patent [19]

Ganzeboom

[11] Patent Number: 6,041,967

[45] Date of Patent: Mar. 28, 2000

[54] RAPID CONNECTING ASSEMBLY FOR AN AEROSOL CAN AND A DISPENSING DEVICE

[75] Inventor: Wilhelmus Everhardus Ganzeboom, Haarlem, Netherlands

[73] Assignee: Bentfield Europe B.V., Netherlands

[21] Appl. No.: 09/051,040

[22] PCT Filed: Oct. 7, 1996

[86] PCT No.: PCT/NL96/00392

§ 371 Date: Mar. 31, 1998

§ 102(e) Date: Mar. 31, 1998

[87] PCT Pub. No.: WO97/13998

PCT Pub. Date: Apr. 17, 1997

[30] Foreign Application Priority Data

Oct. 9, 1995 [NL] Netherlands ..... 1001379

[51] Int. Cl.[7] ..... B67D 5/00

[52] U.S. Cl. ..... 222/82; 222/153.11; 222/402.13; 222/504

[58] Field of Search ..... 222/82, 635, 645, 222/153.11, 402.1, 402.13, 504

[56] References Cited

U.S. PATENT DOCUMENTS

| | | | |
|---|---|---|---|
| 3,974,941 | 8/1976 | Mettler | 222/504 |
| 4,443,028 | 4/1984 | Hayes | 285/38 |
| 5,102,010 | 4/1992 | Osgar et al. | 222/82 |
| 5,242,087 | 9/1993 | Keldenich et al. | 222/153.11 |
| 5,383,580 | 1/1995 | Winder | 222/504 |

FOREIGN PATENT DOCUMENTS

| | | | |
|---|---|---|---|
| 417678 | 11/1910 | France . | |
| 750819 | 1/1945 | Germany . | |
| 2248888 | 4/1992 | United Kingdom | 222/504 |

*Primary Examiner*—Joseph A. Kaufman

*Attorney, Agent, or Firm*—Sughrue, Mion, Zinn, Macpeak & Seas, PLLC

[57] ABSTRACT

Rapid connecting assembly for an aerosol can and a dispensing device. The rapid connecting assembly consists of a first part which is to be connected to the aerosol can and is supplied together with the aerosol can. The second part of the rapid connecting assembly is connected to the dispensing device. A tubular holder is present in this second part, for receiving the tubular part projecting from the aerosol can when the dispensing device and the aerosol can are being connected to each other. For simple connection of the two parts, one of the parts is provided with a lug and the other part is provided with a peripheral edge. The peripheral edge is provided with a flattened part for receiving the lug.

10 Claims, 3 Drawing Sheets

RAPID CONNECTING ASSEMBLY FOR AN AEROSOL CAN AND A DISPENSING DEVICE

The present invention relates to a rapid connecting assembly for an aerosol can and a dispensing device, comprising a first part which is connected to the aerosol can and a second part which is connected to the dispensing device, said second part being provided with a tubular holder for receiving a tubular part projecting from the aerosol can.

Such an assembly is known from U.S. Pat. No. 5,149,053, which discloses a rapid connecting device which is operated by means of a control button. This means that it is necessary for the user to be aware that this button has to be operated in order to obtain a rotary movement of the parts relative to each other.

In the case of such rapid connecting devices the problem is that the user does not know which way he has to move the various parts, either for putting into operation or for taking out of use, and any risk of incorrect positioning of the various parts relative to each other must be avoided.

Aerosol cans for which the rapid connecting assembly according to the invention is intended are used in, inter alia, toilets and the like. In the case of such applications it must be possible for such aerosol cans to be replaced by widely differing unskilled personnel, without it being necessary to check the operation. In other words, it must be ensured that the positioning of the various parts is always automatically correct. This applies in particular to constructions in which a spraying action cannot be produced easily by the replacement person.

It is the object of the present invention to provide a rapid connecting assembly by means of which it is particularly simple for a user to make or break a connection.

This object is achieved in the case of a rapid connecting assembly of the type described above in that at least one lug is fitted on the first part or the second part, the second part or the first part is provided with a peripheral edge with a flattened part, and the height of the flattened part at least corresponds to the height of the lug.

The proposed construction means that if the lug and the flattened part are placed correctly above one another, it is extremely simple to achieve a connection. Sliding the first and second part into each other will produce a snap connection. The connection can be broken by twisting the lug and the flattened part relative to each other, so that the lug grips the part of the peripheral edge which is smooth, i.e. the part which is not provided with a flattened part. A snap connection consequently no longer exists. The user can achieve such disengagement by twisting the parts either clockwise or anticlockwise relative to each other.

The connection between the two parts can be stabilized further by fitting more than one lug and corresponding flattened parts.

It has been stated above that for a locking engagement the flattened part and the lug must ultimately lie opposite each other.

This can be promoted by fitting interacting centering means on the first and second part, so that when these two parts are placed in any arbitrary way relative to each other and are pressed together, such center automatically occurs that the lug and the flattened part ultimately lie opposite each other and snap into each other.

According to a preferred embodiment of the invention, such centering means comprise a projection fitted on one of the two parts and a spiral edge fitted on the other of the two parts, said edge coming into engagement with the projection.

Moving the two parts downwards vertically will cause said edge to engage with the projection at some point and then, through the helical design of the edge, a rotary movement will be carried out in such a way that the lug and flattened part ultimately lie against each other and engage in each other.

Although the projection can be a separately formed part, it preferably comprises the lug described above.

The dispensing device can be any dispensing device known in the prior art. It preferably comprises a dispensing valve which is controlled electromagnetically. Such valves are used in, for example, toilets and are operated in connection with the use thereof. Such a dispensing valve can be immovably fixed to the dispensing device.

The first part situated on the aerosol can is preferably designed in such a way that it provides a protection for the dispensing tube projecting from the aerosol can. This means that there is no risk that if the aerosol can is dropped or is placed upside down, it will lose its contents in an undesirable way.

Moreover, the first part can be provided with tamper-indicating means such as a membrane. This membrane has to be pierced before the tube of the aerosol can is released.

The invention will be explained in greater detail below with reference to an exemplary embodiment illustrated in the drawing, in which.

Figure 1:
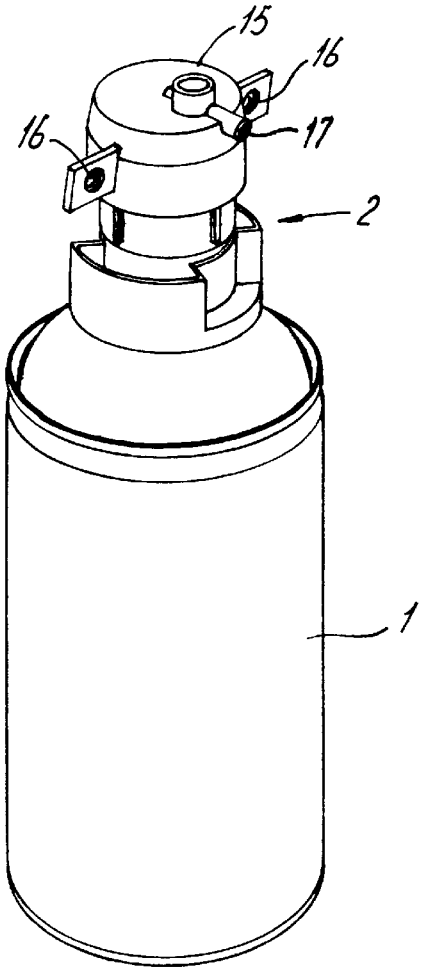
FIG. 1 shows a perspective view of an aerosol can provided with a dispensing device and a rapid connecting assembly according to the invention.

In FIG. 1 an aerosol can is indicated by 1, and the rapid connecting assembly by 2. A dispensing device 15 is situated on top of the rapid connecting assembly. The dispensing device 15 is provided with openings 16 for fixing to a construction which is not shown in any further detail.

Figure 3:
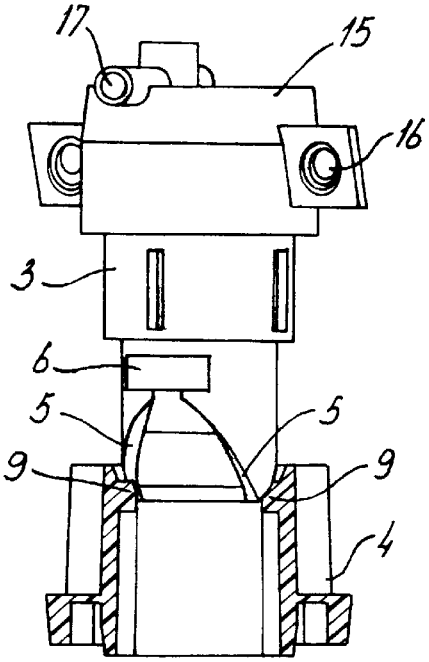
FIG. 3 shows the second part of the rapid connecting assembly being placed on the first part of the rapid connecting assembly.
Figure 2:
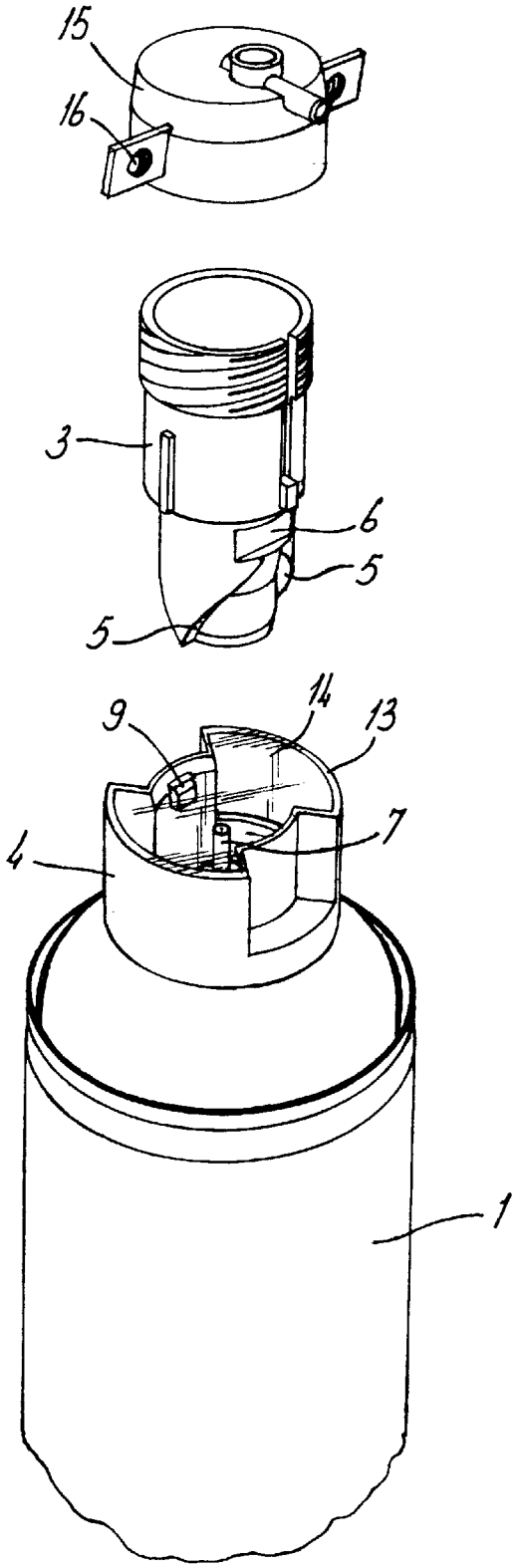
FIG. 2 shows the rapid connecting assembly with the dispensing device and the aerosol can, disassembled.
Figure 4:
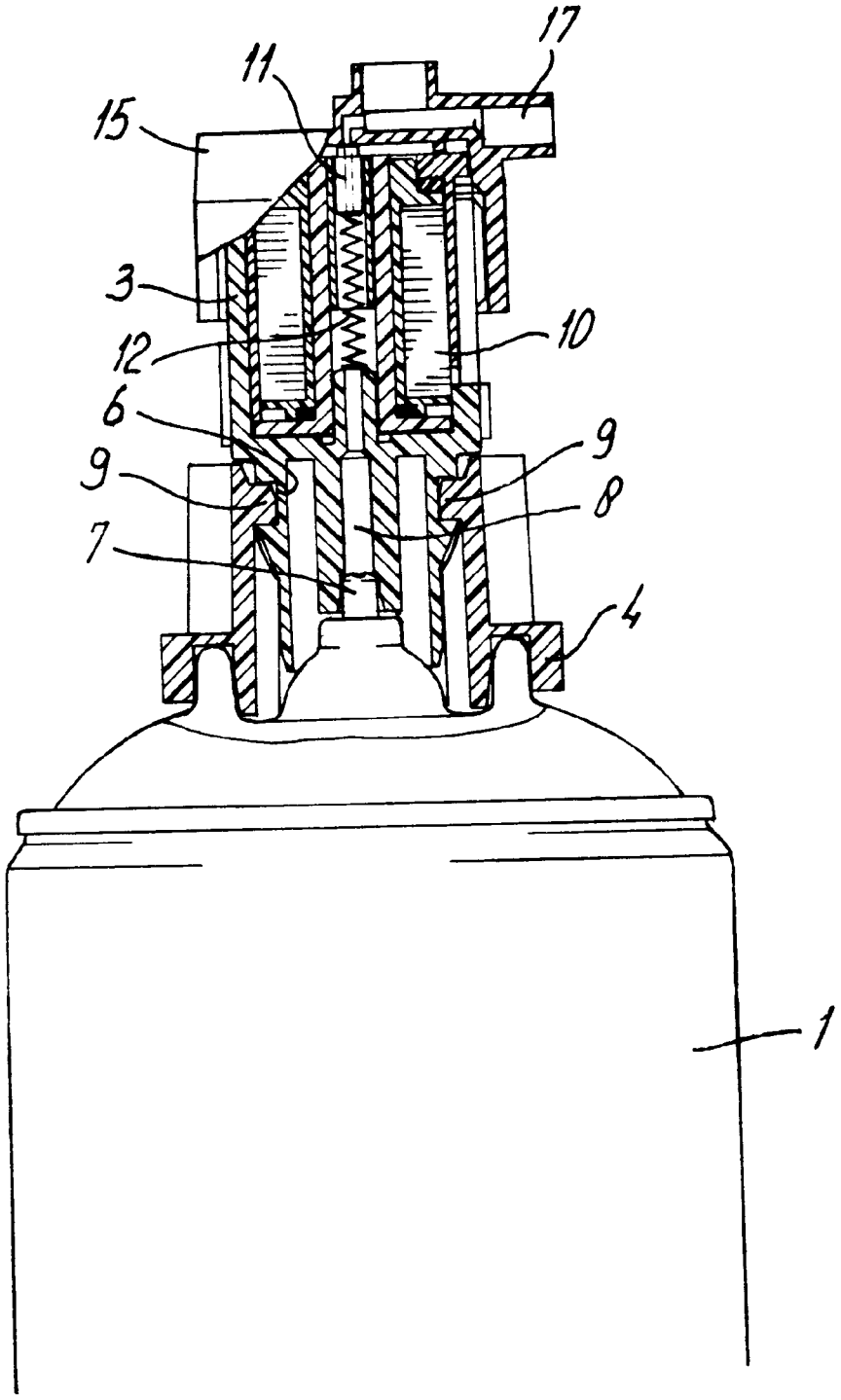
FIG. 4 shows in section the two parts of the rapid connecting assembly being snapped into each other.

FIGS. 2–4 show further details of the rapid connecting assembly 2 according to the invention. It can be seen that it consists of a first part 4 and a second part 3. The first part 4, which is situated on the aerosol can, is placed thereon during production. Part 4 consists of an upward projecting collar provided with two opposite lugs 9. The top edge of the collar is indicated by 13, and said top edge is covered by a membrane 14. Reference number 7 indicates the tube of the aerosol can, which tube, depending on the application, can extend to the bottom of the aerosol can 1.

The second part 3 is provided with a cylindrical bottom end which comprises a flattened part 6. This cylindrical bottom end is also provided with a recess by means of which a spiral edge 5 is bounded. As can be seen from FIG. 4, the dispensing device 15 is fitted on the second part. This dispensing device consists of an electrical coil, to be operated in a manner not shown in any further detail, having fitted in the centre thereof an open chamber in which a plunger 11 made of magnetizable material is driven upwards under the influence of a spring 12 against the valve seat of an outflow aperture 17. It can also be seen from FIG. 4 that when the aerosol can is assembled, tube 7 of the aerosol can engages with a holder 8.

The rapid connecting assembly described above functions as follows. Starting from the position in FIG. 3, i.e. that in which the lug 9 has not been placed opposite the flattened part 6, part 3 is pushed into part 4. In the course of this, edges 5 act upon lugs 9, with the result that part 3 rotates in such a way relative to part 4 that flattened part 6 ultimately lies opposite lug 9. On pushing further, lug 9 then snaps into flattened part 6, and locking occurs. This is shown in FIG. 4.

When the connection between the parts 3 and 4 is to be broken, parts 3 and 4 need only be rotated relative to each other. The direction of rotation is immaterial, as long as lug 9 comes out of flattened part 6. Once this situation is reached, it is easy to slide the parts 3 and 4 out of each other.

If coil 10 is activated, plunger 11 will move downwards against the action of spring 12, and tube 7 will be directly connected to outflow aperture 17.

In this way it is possible to obtain a connection with the rapid connecting assembly according to the invention in the case of which, starting from any position, a connection can be produced and, starting from the locked position, said connection can be undone by rotating in any direction and pulling away again.

Although the invention is described above with reference to a preferred embodiment, it should be understood that numerous modifications can be made thereto without going beyond the scope of the present application.

For example, it is possible to fit the lug in the second part and the flattened part in the first part. The same applies to the centering means. These and other modifications are obvious to any person skilled in the art after reading the above description and the appended claims.

I claim:

1. Rapid connecting assembly for an aerosol can and a dispensing device, comprising:

a first part which is connected to the aerosol can and a second part which is connected to the dispensing device, said second part being provided with a tubular holder for receiving a tubular part projecting from the aerosol can, wherein at least one lug is fitted on one of the first part and the second part, where the other of the second part and the first part, not fitted with said lug, is provided with a peripheral edge with a flattened part, and a height of the flattened part at least corresponds to a height of the lug, and wherein said assembly connects the aerosol can and dispensing device by placing the lug against the peripheral edge and rotating one of the first and second parts, in either direction, such that the lugs snaps into the flattened part.

2. Rapid connecting assembly according to claim 1, wherein said at least one lug is two lugs and said two lugs are fitted opposite each other on one of said first and said second parts.

3. Rapid connecting assembly according to claim 1 in which centering means are fitted upstream of the lug or flattened part, viewed in the direction of connection of the first part and the second part, in order to place the first and second parts in such a way relative to each other that lug and flattened part lie opposite each other.

4. Rapid connecting assembly according to claim 3, in which said centering means comprise a projection which is fitted on the first or second part and a spiral edge which is fitted on the second or the first part and engages with the projection.

5. Rapid connecting assembly according to claim 4, in which the projection comprises the lug.

6. Rapid connecting assembly according to claim 1 in which the dispensing device comprises an electromagnetically controlled dispensing valve.

7. Rapid connecting assembly according to claim 6, in which the dispensing valve is immovably fixed to the dispensing device.

8. Rapid connecting assembly according to claim 1 in which the first part is of such length and can be fixed in such a way to the aerosol can that said part extends substantially beyond the free end of the dispensing tube of the aerosol can when it is in the position ready for use.

9. Rapid connecting assembly according to claim 1 in which the first part is provided with tamper-indicating means.

10. Rapid connecting assembly according to claim 9, in which said tamper-indicating means comprise a membrane for piercing.

* * * * *